United States Patent [19]

Onoda et al.

[11] 4,254,588

[45] Mar. 10, 1981

[54] METHOD OF CONTROLLING INFEED IN THE COMPOUND GRINDING

[75] Inventors: Makoto Onoda; Kazuyoshi Nakajima, both of Iwata, Japan

[73] Assignee: NTN Toyo Bearing Company, Limited, Osaka, Japan

[21] Appl. No.: 22,988

[22] Filed: Mar. 22, 1979

[30] Foreign Application Priority Data

Mar. 22, 1978 [JP] Japan ..... 53/33336

[51] Int. Cl.[3] ..... B24B 1/00; B24B 5/12

[52] U.S. Cl. ..... 51/291; 51/88

[58] Field of Search ..... 51/88, 89, 291

[56] References Cited

U.S. PATENT DOCUMENTS 2,807,916 10/1957 Squire ..... 51/291 X

*Primary Examiner*—Harold D. Whitehead

*Attorney, Agent, or Firm*—Armstrong, Nikaido, Marmelstein & Kubovcik

[57] ABSTRACT

A method of controlling infeed in simultaneously grinding the inner and outer diameters of an annular workpiece with a multiple infeed speed. The method comprises, while supervising the amounts of infeed of the internal and external grind infeeding heads, the finish dimensions of the inner and outer diameters of the workpiece, the infeed positions of the internal and external grind infeeding heads, and the time when inner and outer diameter dimension signals are sent, starting the simultaneous rough grinding of the inner and outer diameters at rough grinding infeed speeds so determined as to simultaneously reach predetermined allowances for precision grinding, completing the rough grinding of the inner diameter in response to a signal indicating the completion of the rough grinding of the outer diameter, and starting precision grinding at precision grinding infeed speeds so determined that when the precision grinding of one diameter is completed, the other diameter has a predetermined allowance for precision grinding left.

7 Claims, 11 Drawing Figures

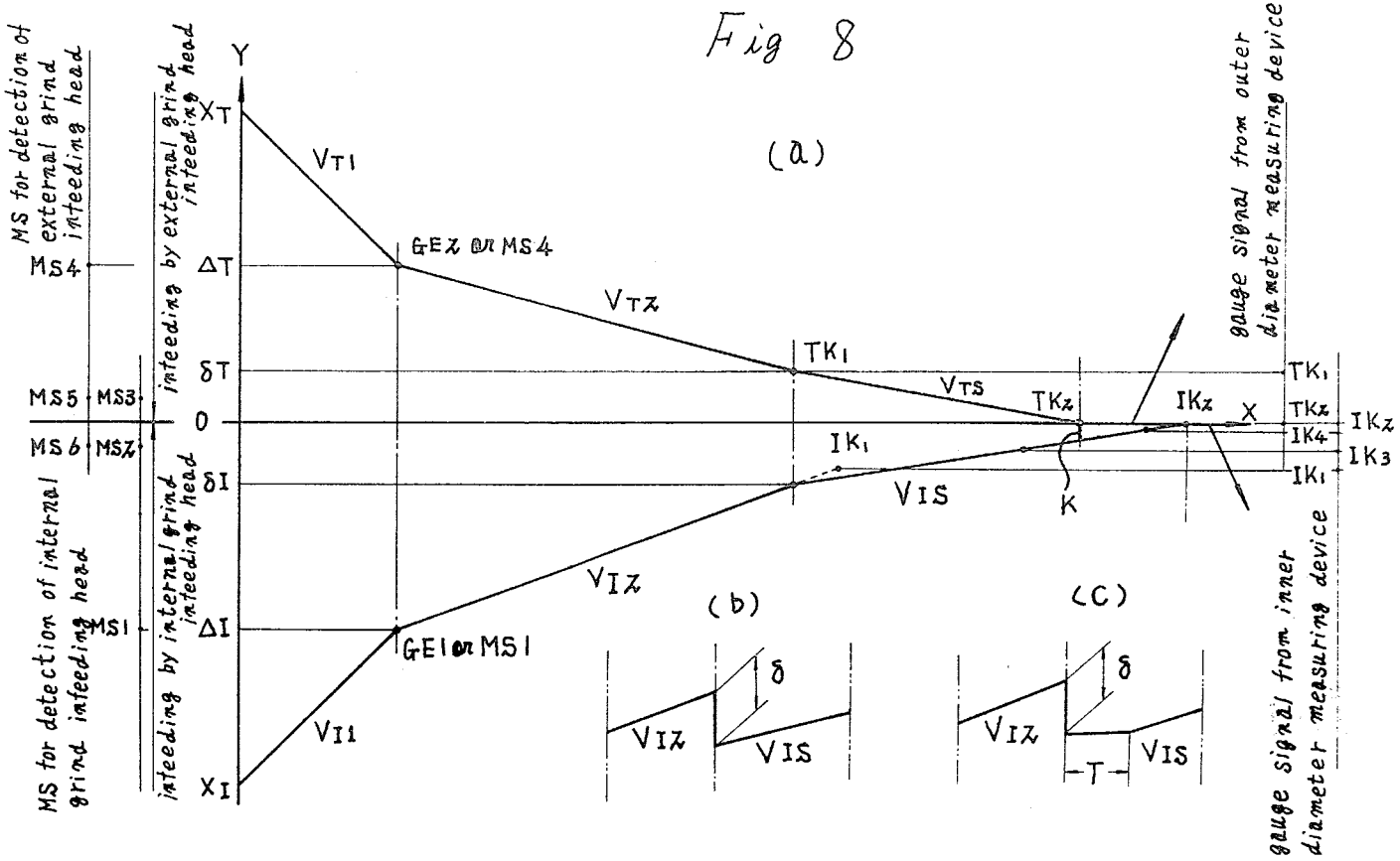
Fig 8
(a)
(b)
(c)
Y
XT
ΔT
δT
0
δI
ΔI
XI
VT1
VT2
VT3
VI1
VI2
VI3
GE2 on MS4
GE1 on MS1
TK1
TK2
IK1
IK2
IK3
IK4
K
X
δ
T
MS for detection of external grind infeeding head
MS for detection of internal grind infeeding head
MS4
MS5
MS6
MS3
MS2
MS1
infeeding by external grind infeeding head
infeeding by internal grind infeeding head
gauge signal from outer diameter measuring device
gauge signal from inner diameter measuring device

METHOD OF CONTROLLING INFEED IN THE COMPOUND GRINDING

BACKGROUND OF THE INVENTION (a) Field of the Invention

The present invention relates to a method of controlling infeed in the so-called compound grinding for simultaneously grinding the inner and outer diameters of an annular workpiece, e.g., a bearing race on a single grinding machine.

(b) Description of the Prior Art

Generally, taking a bearing race as an example, the grinding of such annular workpiece is performed as follows.

First, the width surface of a workpiece having undergone pre-processes including lathing and heat-treatment is ground on a double head type surface grinding machine, followed by the grinding of the outer diameter on a centerless support type outer diameter grinding machine with said width surface as a reference, and then by the grinding of the inner diameter with said outer diameter as a reference. If the workpiece is particularly low in rigidity, the inner and outer diameters will be re-ground to maintain accuracy. Therefore, the processing of this kind of work requires a variety of grinding machines and a large installation space therefor, involving facility investment. It also requires transfer equipment such as chutes connecting grinding machines, and a large number of operators. In order to solve these problems, there has heretofore been a demand for developing a technique concerning the compound grinding of inner and outer diameters.

FIG. 1 illustrates a prior art embodiment of a compound grinding machine shown in U.S. Pat. No. 2,807,916 developed in response to such demand. As is clear from FIG. 1, this grinding machine comprises an outer diameter grinding device 1 and an inner diameter grinding device 2 which are arranged side by side, the arrangement being such as to solve the problems of said installation space, facility investment, transfer equipment and the number of operators. However, it has still been insufficient as to the shortening of cycle time, grinding accuracy, and adaptability to mass-production.

FIGS. 2 through 4 illustrate a compound grinding technique further advanced as compared with FIG. 1. In FIG. 2, the numeral 3 designates a spindle; 4 designates a driving plate attached to said spindle; 5 designates a workpiece; 6 designates an inner diameter grinding stone; and 7 designates an outer diameter grinding stone. The workpiece 5 is magnetically chucked to the driving plate 4 and, as shown in FIG. 3, it is centerless-supported as at 8*a* and 8*b*. The direction of rotation and the direction of infeed are as shown and the processing cycle is as shown in FIG. 4. In FIG. 4, (a) and (b) indicate cycles for the outer diameter grinding stone 7, (a) referring to infeed in the direction of X-axis and (b) referring to infeed in the direction of Y-axis. Further, (c) and (d) indicate cycles for the inner diameter grinding stone 6, (c) referring to infeed in the direction of Y-axis and (d) referring to infeed in the direction of X-axis. In this case, the workpiece 5 is a bearing inner race and the outer diameter grinding stone 7 is used to grind a rolling groove therein. Therefore, the Y-axis infeed (oscillation) of the outer diameter grinding stone 7 is not performed. The outer and inner diameter grinding stones 7 and 6 start infeeding at the same time. The outer diameter grinding stone 7 shifts continuously from rough grinding to precision grinding and, upon completion of operation, it sparks out for a fixed period of time and then returns rapidly. On the other hand, in the Y-axis infeed (traverse feed) (c) of the inner diameter grinding stone 6, oscillation is performed and in the X-axis infeed (d), rough grinding is performed simultaneously with rough grinding in (a). Immediately before completion of precision grinding by the outer diameter grinding stone 7, infeed (d) is once stopped and in infeed (d) the stone 6 is retracted to be subjected to dressing. Simultaneously with rapid return of the outer diameter grinding stone 7, oscillation is started in infeed (c), and in infeed (d) precision grinding is started. Upon completion of this precision grinding, spark out takes place, and rapid return takes place slightly earlier in infeed (d) than in infeed (c).

In the prior art, as described above, since precision grinding by the inner diameter grinding stone 6 is started simultaneously with the rapid return (with precision grinding completed) of the outer diameter grinding stone 7, the balance of the force exerted by the infeed of the inner diameter grinding stone 6 during that portion of the period of inner diameter grinding which requires the highest accuracy in such inner diameter grinding is upset, lifting the workpiece 5 at the shoe 8*b* (see FIG. 3), so that accurate support for the workpiece 5 can no longer be obtained, thus entailing the lowering of dimensional and configurational accuracy. To avoid this would involve the problem of prolonging the cycle time. That is, the compound grinding technique described above is a mere superposition of the conventional inner and outer diameter grinding cycles.

SUMMARY OF THE INVENTION

The present invention provides a method of controlling infeed in simultaneously grinding the inner and outer diameters of an annular workpiece with a multiple infeed speed, said method comprising, while supervising the amounts of infeed of the internal and external grind infeeding heads, the finish dimensions of the inner and outer diameters of the workpiece, the infeed positions of the internal and external grind infeeding heads, and the time when inner and outer diameter dimension signals are sent, starting the simultaneous rough grinding of the inner and outer diameters at rough grinding infeed speeds so determined as to simultaneously reach predetermined allowances for precision grinding, completing the rough grinding of the inner diameter in response to a signal indicating the completion of the rough grinding of the outer diameter, and starting precision grinding at precision grinding infeed speeds so determined that when the precision grinding of one diameter is completed, the other diameter has a predetermined allowance for precision grinding left.

FEATURES OF THE INVENTION

An object of the invention is to shorten the cycle time by finishing the inner and outer diameters simultaneously in a single grinding operation, and to advantageously solve the problems of equipment cost, installation space and maintenance by performing the simultaneous grinding of the outer diameter on a single grinding machine.

Another object of the invention is to improve dimensional and configurational accuracy by meeting the severe conditions of simultaneous inner and outer diameter grinding, particularly by overcoming the grinding resistance so as to stably hold the workpiece on the shoes and by setting a special infeed speed.

Another object of the invention is to avoid adverse effects including a chuck deformation which would be produced during rough grinding by changing the chucking pressure on the workpiece to a low pressure upon completion of rough grinding, and to achieve accurate infeed timing and hence high accuracy for inner and outer diameters by slightly retracting the internal grind infeeding head upon completion of rough grinding so as to relieve the quill of its deflection.

A further object of the invention is to provide an arrangement wherein the infeed cycles for simultaneously grinding the inner and outer diameters of an annular workpiece with high efficiency and high precision proceed while maintaining the same relative proceeding relation to workpieces being mass-produced to assure that there is no variation in the processing size and processing accuracy among the workpieces.

BRIEF DESCRIPTION OF THE DRAWINGS

FIG. 8 is a cycle diagram for external grinding precedence;

DESCRIPTION OF THE PREFERRED EMBODIMENTS

The present invention provides a method of controlling infeed by utilizing a shoe construction which, while overcoming the severe conditions of simultaneous grinding of the inner and outer diameters of a workpiece to stably hold the workpiece on shoes, enables the processing to be carried out without adversely influencing dimensional and configurational accuracy, so that predetermined dimensional and configurational accuracy can be secured while shortening the cycle time.

Figure 1:
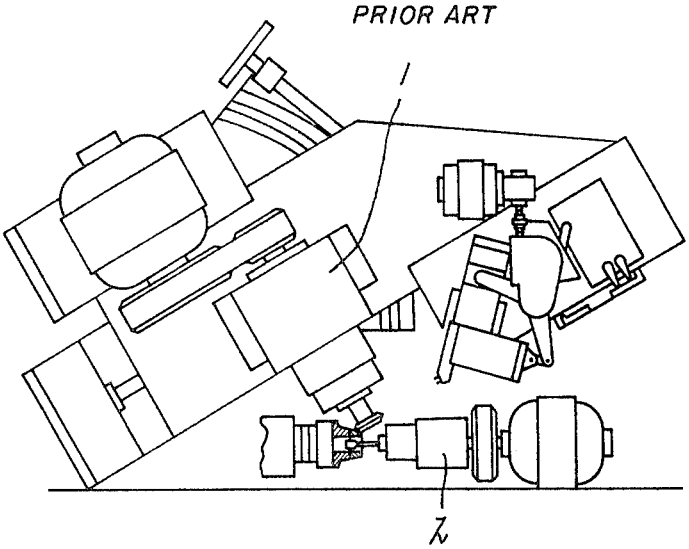
Fig 1 PRIOR ART
FIG. 1 is a plan view of a compound grinding machine according to an embodiment of the prior art.
Figure 2:
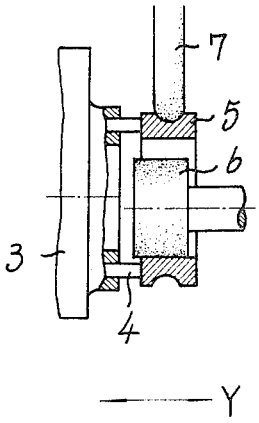
Fig 2 PRIOR ART
FIG. 2 is a side view of a principal portion illustrating another embodiment of the prior art grinding a workpiece.
Figure 3:
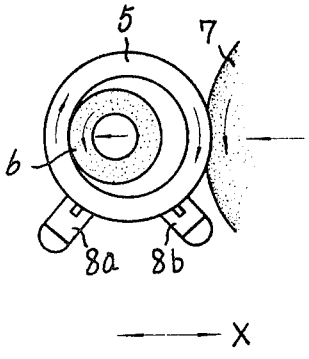
Fig 3 PRIOR ART
FIG. 3 is a front view of FIG. 2.
Figure 4:
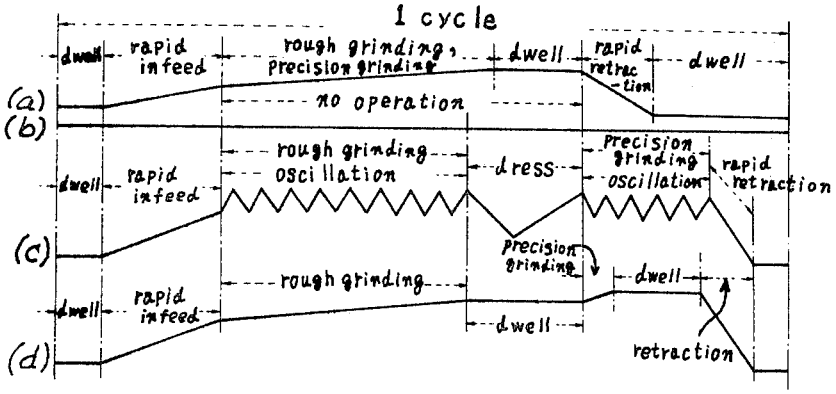
Fig 4 PRIOR ART
FIG. 4 is a cycle diagram therefor.
Figure 5:
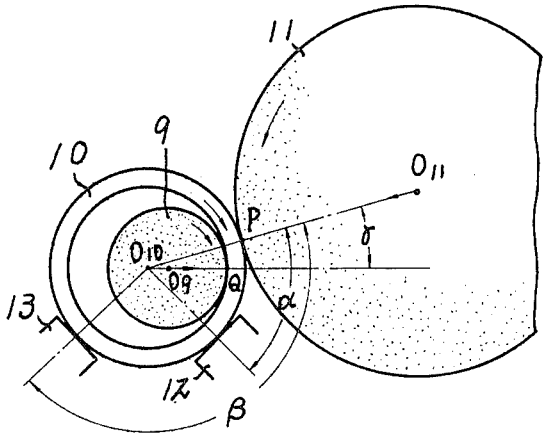
FIG. 5 is a view showing how a workpiece is supported and ground according to the present invention.

Before going into details of the apparatus and method of the invention, a work support structure of the centerless support type for a grinding machine used in the invention will be described with reference to FIG. 5. With this method of support, the center $O_9$ of an inner diameter grinding stone 9 and the center $O_{10}$ of an annular workpiece 10 are located on a substantially horizontal line. With respect to a line connecting the centers $O_9$ and $O_{10}$, an outer diameter grinding stone 11 is displaced around the center of the workpiece 10 through an angle $\gamma$ of at least 5 degrees. More particularly, a point of contact P between the outer diameter grinding stone 11 and the outer diameter of the workpiece 10 is located above the level of a point of contact Q between the inner diameter grinding stone 9 and the inner diameter of the workpiece 10, and front and rear shoes 12 and 13 form angles $\alpha$ and $\beta$, respectively, with a line connecting the center $O_{11}$ of the outer diameter grinding stone 11 and the center $O_{10}$ of the workpiece 10, said shoes supporting the workpiece 10 and being positioned such that $\alpha=30$–$60$ degrees and $\beta=150$–$180$ degrees. As a result, the moment tending to turn the workpiece 10 around its point of contact with the front shoe 12 is reduced, so that the workpiece 10 will not be lifted from the rear shoe 13 even when its inner diameter is being ground.

Therefore, this arrangement enables the workpiece 10 to be safely held under the severe conditions of rough grinding.

The method of controlling infeed according to the invention for processing the workpiece 10 with high precision and high efficiency while stably and firmly holding it will now be described.

Figure 6:
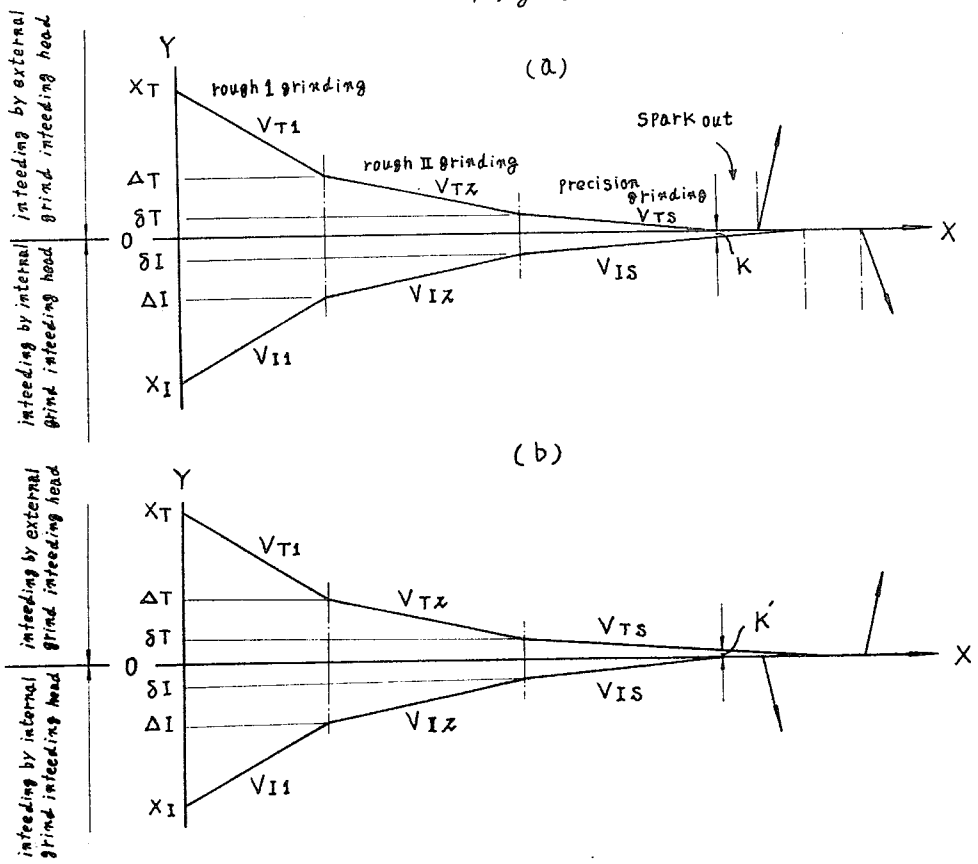
FIG. 6 is a diagram showing the basic cycle of the invention.

First, the setting of infeed speed according to the invention will be described. FIG. 6 is a cycle diagram showing the basic principles of the infeed control method of the invention, the upper half of the diagram showing the infeed cycle of the outer diameter grinding stone 11 and the lower half showing the infeed cycle of the inner diameter grinding stone 9. The vertical axis indicates workpiece radius grinding allowance (grinding stone infeed) and its intersection with the horizontal axis indicates zero allowance, namely the completion of precision grinding. The horizontal axis indicates time.

FIG. 6 depicts three infeed speeds for rough I grinding, rough II grinding and precision grinding, said infeed speeds being determined by the grinding ratio for a particular grinding stone (volume removed by grinding/volume of wear of grinding stone) and the grinding efficiency (volume removed per unit time by grinding) which, in turn, are dependent on workpiece material. That is, with due consideration given to the conditions for rough I grinding, rough II grinding and precision grinding, namely, "very quick removal of strain in workpiece produced in preceding process", "quick grinding until precision grinding allowance is reached without causing the coming off or burning of grinding stone which influences final workpiece shape" and "avoiding stone burn in rough II grinding and securing grinding precision concerning workpiece surface roughness, circularlity and size", if said grinding efficiency is predetermined on the basis of a particular workpiece material and grinding performance including grinding ratio for a particular grinding stone, the infeed speed can be uniquely determined by the following equation.

$$V=Z'/(\pi d)$$

Z': grinding efficiency ($mm^3$/sec. mm)

d: workpiece diameter (mm)

V: infeed speed (mm/sec.)

If the target Z' value with respect to respective infeed speed is predetermined as described above, the relative relation for compound grinding between infeed speeds for inner and outer diameters can be determined as follows.

Let $V_{T1}$ be the infeed speed of the outer diameter grinding stone for rough I grinding, $V_{T2}$ be the infeed speed thereof for rough II grinding, $V_{Ts}$ be the infeed speed thereof for precision grinding, and similarly let $V_{I1}$, $V_{I2}$ and $V_{Is}$ be the infeed speeds of the inner diameter grinding stone, and let d1 and do be the inner and outer diameters of the workpiece, Z' be the rough I grinding maximum Z' value, $Z_2$ be the rough II grinding maximum Z' value, and $Z_s$ be the rough grinding maximum Z' value. Then, the maximum infeed speeds can be obtained as follows.

$$V_{T1}\max = Z_1/\pi x do \quad \text{(a)}$$

$$V_{T2}\max = Z_2/\pi x do \quad \text{(b)}$$

$$V_{Ts}\max = Z_s/\pi x do \quad \text{(c)}$$

$$V_{I1}\max = Z_1/\pi x di \quad \text{(d)}$$

$$V_{I2}\max = Z_2/\pi x di \quad \text{(e)}$$

$$V_{Is}\max = Z_s/\pi x di \quad \text{(f)}$$

The basic principles of the present inventive method of controlling infeed on the basis of the thus obtained infeed speeds will now be described with reference to FIG. 6 (a). FIG. 6 (a) refers to the outer diameter grinding precedence cycle. The outer diameter grinding precedence refers to a control method employed when the inner diameter of a workpiece requires a particularly higher accuracy than the outer diameter, wherein the outer diameter grinding is completed earlier than the inner diameter grinding so that during the precision grinding exclusive to the inner diameter the accuracy thereof can be improved. (Such case is hereinafter referred to as outer diameter grinding precedence and the reversed case the inner diameter grinding precedence, see FIG. 6 (b)).

Let $X_T$ be the overall amount of infeed of the outer diameter grinding stone 11, $X_T-\Delta T$ be the amount of rough I grinding, $V_{T1}$ be the infeed speed thereof, $\Delta T-\delta T$ be the amount of rough II grinding, $V_{T2}$ be the infeed speed thereof, $\delta T$ be the amount of precision grinding, $V_{Ts}$ be the infeed speed thereof, $X_I$ be the overall amount of infeed of the inner diameter grinding stone, $X_I-\Delta I$ be the amount of rough I grinding, $V_{I1}$ be the infeed speed thereof, $\Delta I-\delta I$ be the amount of rough II grinding, $V_{I2}$ be the infeed speed thereof, $\delta I$ be the amount of precision grinding, and $V_{Is}$ be the infeed speed thereof. Then, the outer diameter grinding stone 11 starts infeeding at $X_T$ with its rough I infeed speed while the inner diameter grinding stone 9 starts infeeding at $X_I$ with its rough I infeed speed. When the outer diameter grinding stone 11 infeeds to $\Delta T$, the inner diameter grinding stone 9 leaves an allowance for grinding equal to $\Delta I$. Then, they simultaneously enter into the phase of rough II grinding. When the outer diameter grinding stone 11 comes to have the remaining allowance $\delta T$, the inner diameter grinding stone 9 has the remaining allowance $\delta I$. At the same time as the precision grinding infeed starts, the rough II grinding is completed.

When the outer diameter grinding stone 11 finishes infeeding to zero, the inner diameter grinding stone 9 has an allowance K left. Thus, the outer diameter grinding stone 11 is then retracted first, while the inner diameter grinding stone 9 infeeds to zero and is then retracted. In order to make up such cycle, the following relations of infeed speeds, in consideration of the inner and outer diameter grinding allowances, are required.

$$\left.\begin{aligned} \frac{X_T-\Delta T}{V_{T1}} &= \frac{X_I-\Delta_I}{V_{I1}} \\ \frac{\Delta T-\delta T}{V_{T2}} &= \frac{\Delta I-\delta I}{V_{I2}} \\ \frac{\delta T}{V_{TS}} &= \frac{\delta I-K}{V_{IS}} \end{aligned}\right\} \quad (1)$$

Similarly, in the case of the inner diameter grinding precedence cycle, the following conditions are required, (see FIG. 6 (b)).

$$\left.\begin{aligned} \frac{X_T-\Delta T}{V_{T1}} &= \frac{X_I-\Delta I}{V_{I1}} \\ \frac{\Delta T-\delta T}{V_{T2}} &= \frac{\Delta I-\delta I}{V_{I2}} \\ \frac{\delta T-K'}{V_{TS}} &= \frac{\delta I}{V_{IS}} \end{aligned}\right\} \quad (2)$$

As clear from said equations (a)-(f), if the grinding conditions are the same or particularly the grinding performance is the same, since outer diameter > inner diameter, the inner diameter grinding infeed speed is greater than the outer diameter grinding infeed speed, and the inner diameter grinding infeed speed = the outer diameter grinding infeed speed × (outer diameter/inner diameter) . . . (3). Since the overall amounts of infeed $X_T$ and $X_I$ are determined by the inner and outer diameter grinding allowances, if, with the equation (3) taken into consideration, the infeed speed for one diameter for which the grinding conditions are more severe (the cycle is longer) is selected, the amount of infeed and the infeed speed for the other diameter can be determined by the equation (1) or (2), so that the cycle time becomes minimum and the optimum conditions for simultaneous inner and outer diameter grinding can be obtained.

In brief, the principles of the infeed cycle of the invention comprise the following three main points.

1. Upon completion of the rough grinding, whereas the outer diameter precision grinding allowance is $\delta T$, the inner diameter precision grinding allowance is always $\delta I$;

2. Upon completion of the grinding of the preceding surface (for example, outer diameter), the precision grinding allowance for the succeeding surface (for example, inner diameter) has a fixed amount (KorK') left;

3. The change of feed speed is controlled by an output signal from the outer diameter grinding section.

The infeed speed relations obtained through the above investigation are applied to these three main points to make it possible to shorten the cycle time and secure processing accuracy.

In the actual grinding operation, however, since dead time due to variations in the grinding allowance among workpieces cannot be avoided, the above basic principles cannot be directly applied. Thus, correction is made in applying the principles, as will be later described.

Figure 7:
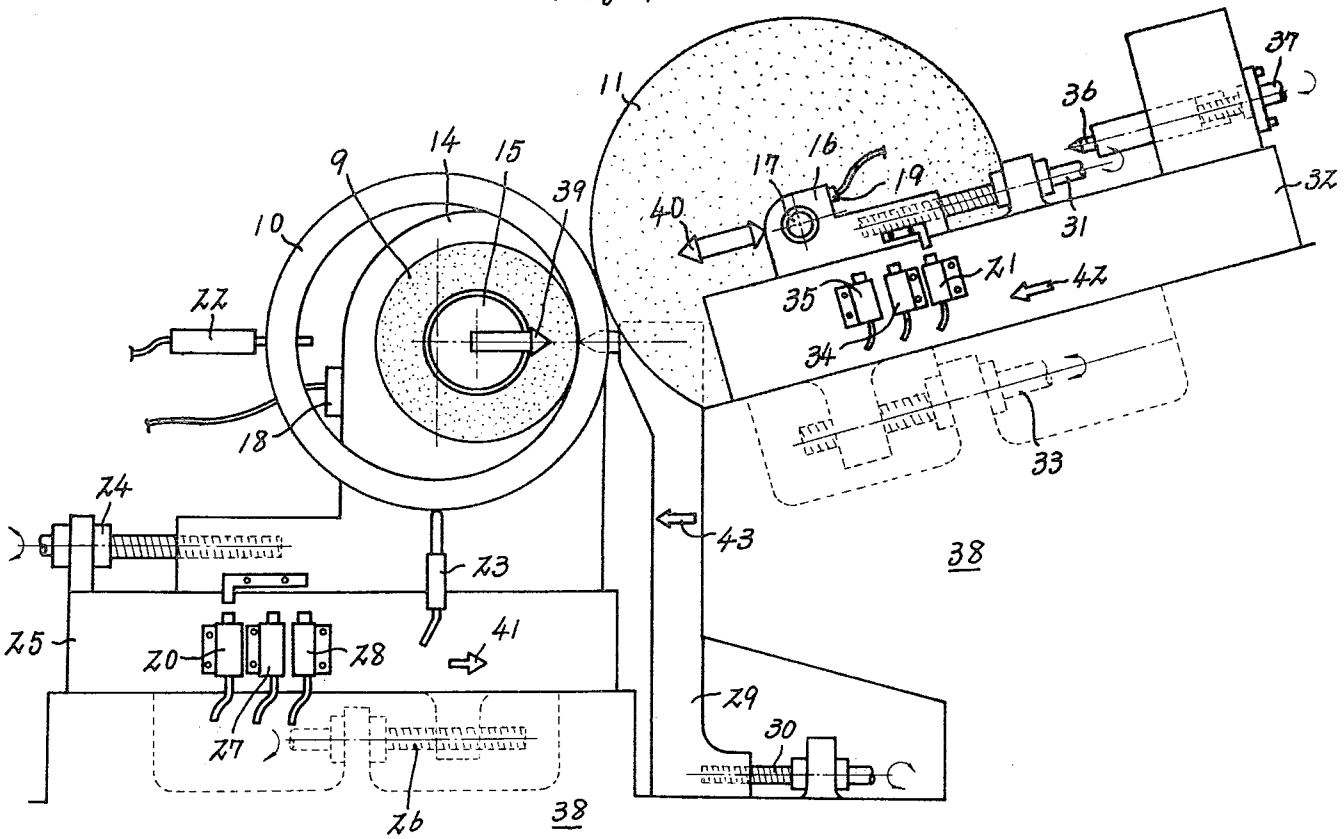
FIG. 7 is a view showing an apparatus according to an embodiment of the invention.

The apparatus and the infeed cycle therefor according to the invention considered in the above investigation will now be described with reference to FIGS. 7 and 8. An external grind infeeding head 16 will be first described. The external grind infeeding head 16 comprises an external grind infeed compensation device 33 attached to a machine bed 38, whereby an external grind compensation member 32 is advanced (as indicated by an arrow 42) by a predetermined amount. This compensation member 32 has attached thereto an outer diameter rough grinding completion microswitch 21, an outer diameter grinding stone large microswitch 34, an outer diameter grinding stone small microswitch 35, an external grind infeeding device 31, and a dress compensation device 37, to be later described. When the infeeding device 31 causes the external grind infeeding head 16 to perform its infeeding operation (as indicated by an arrow 40), the outer diameter grinding stone 11 attached to the infeeding head 16 infeeds, In response to this infeeding movement, the microswitches 21, 34 and 35 successively produce output signals $MS_4$, $MS_5$, and $MS_6$.

On the other hand, the internal grind infeeding head 14 comprises an internal grind infeed compensation device 26 attached to the machine bed 38, whereby an internal grind compensation member 25 is advanced in the direction of arrow 41 by a predetermined amount. The compensation member 25 has attached thereto an internal grind completion microswitch 20, an inner diameter grinding stone large microswitch 27, an inner diameter grinding stone small microswitch 28, and an internal grind infeeding device 24, to be later described. When the infeeding device 24 causes the internal grind infeeding head 14 to infeed in the direction of arrow 39, the inner diameter grinding stone 9 infeeds. An internal grinding stone dressing device 29 is moved (in the direction of arrow 43) by a dress compensation device 30 fixed on the machine bed 38.

The workpiece 10 is supported by a support device (not shown) and is driven by a driving plate (not shown). The support device includes an inner diameter measuring device 22 and an outer diameter measuring device 23. The inner diameter measuring device 22 has, in its output signals, comparison signals for a rough grinding completion point $IK_1$, a dimension zero point $IK_2$, an inner diameter allowance large point $IK_3$, and an inner diameter allowance small point $IK_4$. The outer diameter measuring device 23 has, in its output signals, comparison signals for a rough grinding completion point $TK_1$, a dimension zero point $TK_2$, an outer diameter allowance large point $TK_3$, and an outer diameter allowance small point $TK_4$. Further, the external grind infeeding head 16 is provided with a gap eliminator 19 for detecting outer diameter grinding power, while the internal grind infeeding head 14 is provided with a gap eliminator 18 for detecting inner diameter grinding power. These gap eliminators will produce a GE signal when the grinding stone driving power exceeds a preset value. In addition, the signal from the gap eliminator 18 is named GE1 and the GE signal from the gap eliminator 19 is named GE2.

The infeed control method applied to the apparatus of FIG. 7 will now be described with reference to FIGS. 8 (*a*) through (*c*), which refer external grinding precedence. The horizontal axis X indicates time and the vertical axis Y indicates the amounts of movement (or infeed) of the internal and external grind infeeding heads. The external grind infeeding head 16 starts infeeding from $X_T$ toward O, while the internal grind infeeding head 14 starts infeeding from $X_I$ toward O. The left-hand side vertical axis indicates the relation between the infeeding positions of the two infeeding heads 14 and 16 and the time when the microswitches attached to the infeeding heads send signals. The right-hand side vertical axis indicates the relation between the infeeding positions of the two infeeding heads 14 and 16 and the time when the inner and outer diameter measuring devices 22 and 23 send signals.

Thus, when the cycle is started, the two grinding stones 9 and 11 are substantially simultaneously dressed. In this state, the external and internal grind infeeding heads 16 and 14 have assumed positions corresponding to the amounts of infeed $X_T$ and $X_I$, respectively, with respect to the final finish size. After dressing is completed, infeeding operations are substantially simultaneously started at the rough I infeed speeds. This rough I is a process step extending from the time inner and outer diameter grinding stones 9 and 11 come in contact with the workpiece 10 until the time they remove the strains produced in the preceding process. Which of the two grinding stones 9 and 11 is the first to come in contact with the workpiece 10 depends on the amount of grinding allowance of work. In the invention, if the outer diameter grinding stone 11 contacts the workpiece earlier, a signal GE2 is produced as a result of an increase in the stone driving power. Similarly, if the inner diameter grinding stone 9 is the first to contact, a signal GE1 is produced. Either the signal GE2 or the signal GE1 causes the infeed speeds of both infeeding heads 16 and 14 to be simultaneously changed to the rough II infeed speeds.

In addition, in order to avoid erroneous processing which would be caused in the event of the gap eliminators 18 and 19 getting out of order or the grinding allowance of the workpiece 10 being too small, there are provided $M_{s4}$ (microswitch 21) and $M_{s1}$ (microswitch 20) besides the gap eliminators 18 and 19. That is, there is provided mechanical external signaling means for assuring said change to rough II infeed.

In this way, the rough II infeed starts, and when the remaining amount of infeed for the outer diameter becomes $\delta T$, the outer diameter measuring device 23 produces a comparison signal $TK_1$ corresponding to said $\delta T$, whereby the infeeding operations for the internal and external rough II grinding are simultaneously changed to precision grinding.

In this connection, the internal rough grinding has produced a deflection in the quill 16 because of its low rigidity. Thus, if the workpiece in such state is finished, there would result disadvantages including the lowering of processing accuracy due to variations in the inner diameter taper and the malfunction of dimension output signals for control. More particularly, because of the severe conditions for simultaneous inner and outer diameter grinding, the shift from rough grinding infeed to precision grinding infeed has the following adverse effects on processing accuracy.

1. Because of high efficiency infeeding cycle, the internal rough grinding produces a deflection in the quill 15, which is low in rigidity. Under such conditions, if the workpiece is subjected to precision grinding, this will form a cause of producing inferior articles having inner diameter taper variations;

2. The same factor as in Paragraph 1 forms a cause of the erroneous detection of dimension output signals for controlling infeed;

3. The chucking force for holding the workpiece by overcoming the severe grinding conditions deforms the workpiece, thus lowering processing accuracy; and 4. The severe grinding conditions cause a build-up of thermal deformation owing to the heat of grinding, thus lowering processing accuracy.

According to the invention, therefore, in shifting from rough grinding infeed to precision grinding infeed, as shown in FIG. 8, after the rough grinding is completed, the internal grind infeeding head 14 along is slightly retracted (FIG. 8, *b*) or after said retraction, the quill 15 is allowed to spark out for a predetermined time T depending how it elastically recovers from its deflection (FIG. 8, *c*) or simultaneously with such procedure, the chucking force is changed (from high to low pressure) to release the deforming force exerted by chucking (to allow deformation due to internal stress), whereupon the workpiece is finished to the predetermined shape and size by the subsequent step, namely, the precision grinding.

Further, according to the invention, the attendant prolongation of the cycle time caused by the above mentioned procedures is avoided in the following way.

Figure 11:
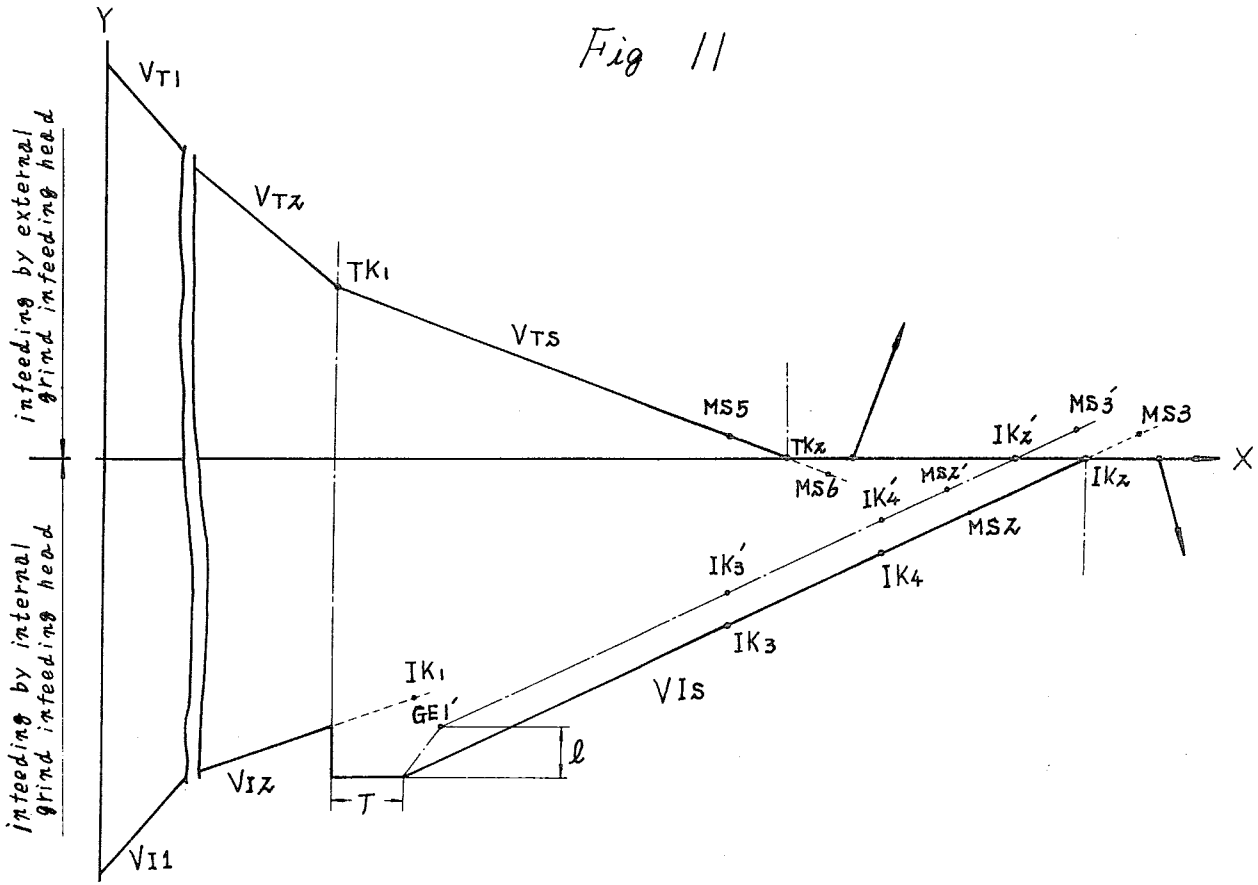
FIG. 11 is a cycle diagram for external grinding precedence, showing another embodiment of the invention.

As shown in FIG. 11, at the start of the precision grinding infeed, it is not actually started at the precision grinding infeed speed at once but it proceeds at the rough II grinding infeed speed only through an amount of infeed 1 which is substantially equal to idle grinding. The gap eliminator 18 then detects as at (GE1') the actual start for grinding (the point of time when the grinding power is equal to that of precision grinding), and this signal GE1' is used to shift it to the precision grinding, thereby shortening the cycle time.

In addition, this gap eliminator is, of course, applicable to detection in connection with the outer diameter grinding. Further, these two techniques are also applicable at the time of starting the precision grinding after the so-called intermediate dress which is performed after the rough grinding.

After such procedure, the precision grinding infeed is started, but the comparison signal $IK_1$ from the inner diameter measuring device 22 does not usually work. The signal $IK_1$ is used to control the shifting of the internal and external grinding infeeds when and only when there is a danger that for some reason (for example, a variation in the rough grinding infeed speed), the internal grind infeeding head 14 precedes and hence the inner diameter would be finished, that is, $IK_1$ would be sent before the signal $TK_1$ is sent. The precision grinding proceeds and when the outer diameter dimension becomes "zero", the comparison signal $TK_2$ is sent and the external grinding infeed is stopped (along with spark out, if necessary), followed by retraction. The precision grinding allowance K for internal grinding, as when this signal $TK_2$ is sent, is measured by the comparison signal from the inner diameter measuring device 22. That is, the remaining grinding allowance K according to the previously described equation (3) is limited such that $IK_4 \leqq K \leqq IK_3$, and the cycle is examined and when K is within the range, a calibrating operation is performed at the end of the cycle. This calibration is mainly intended to prevent the relative proceeding relation of infeed cycles for both inner and outer diameters from varying for different workpieces, so as to enable both infeeds to proceed while always maintaining the same proceeding relation. Further, when this signal $TK_2$ is sent, the position of the external grind infeeding head 16 is examined by $MS_5$ and $MS_6$ and calibration therefor is carried out at the end of cycle. On the other hand, the internal grind infeeding head 14 is still advancing for infeed for precision grinding even when the external grind infeeding head 16 is retracting. When the precision grinding allowance for the inner diameter becomes zero, a signal $IK_2$ is sent from the inner diameter measuring device 22. At this time, the position of the internal grind infeeding head 14 is examined by $MS_2$ and $MS_3$ and a calibrating operation is performed at the end of the cycle. When this signal $IK_2$ is sent, the internal grind infeeding head 14 is stopped (along with spark out, if necessary), and then retracted.

Figure 9:
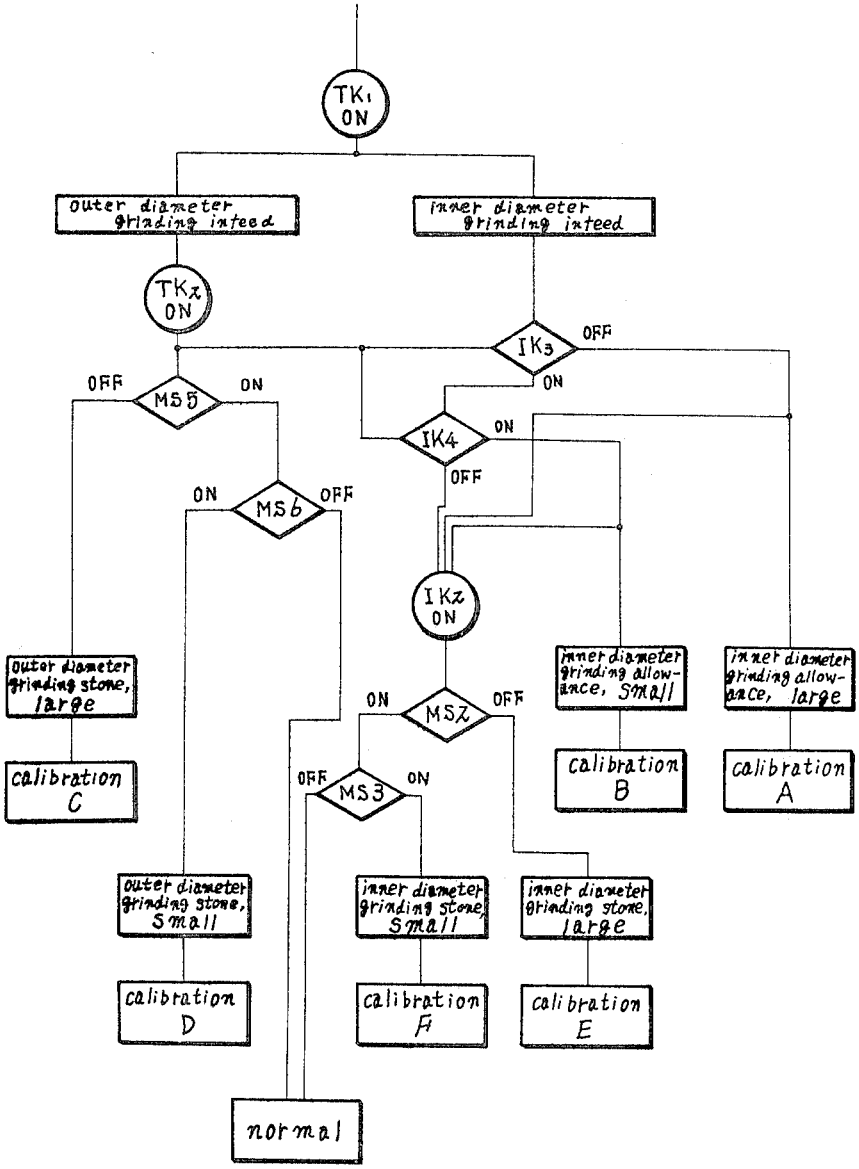
FIG. 9 is a block diagram for explaining a calibrating operation therefor.

The calibrating operation referred to above will now be described in more detail. This is divided into stages A through F, as shown in FIG. 9, according to how the cycle proceeds.

Calibration A is associated with "inner diameter grinding allowance, large" and refers to a case where the infeed by the external grind infeeding head 16 precedes too much beyond a preset value for the internal grind infeeding head 14. In order to normalize the cycle, it is necessary to move back the starting point of infeed of the outer diameter grinding stone 11. The calibration for this purpose can be effected by reversely rotating the external grind infeed compensation device 33 to move back the external grind infeed compensation member 32 in a direction opposite to the direction of arrow 42. Calibration B is associated with "inner diameter grinding allowance, small" and refers to a case where the infeed by the external grind infeeding head 16 delays and is behind a preset value for the internal grind infeeding head 16. In order to normalize the cycle, this may be attained by forwardly rotating the compensation device 33 to advance the external grind infeed compensation member 32 in the direction of arrow 42. In the present invention, since the cylce is arranged to be gaugematic on the basis of external grind infeed from the standpoint of machine rigidity and dimensional stability, as described above, stability can be increased by effecting calibration on the external grind head side.

Synchronization between the outer diameter grinding infeed and the inner diameter grinding infeed has thus become possible. Thus, if the cycle is gradually getting out of order owing, for example, to the wear of the dressers 36 and 29, this can be remedied by said calibrating operations A and B. With such calibrating operations, however, if "inner diameter grinding allowance, large" is successively calibrated, the outer diameter grinding stone 11 is moved back and the overall amount of infeed increases to prolong the cycle time, while if "inner diameter grinding allowance, small" is successively calibrated, the overall amount of infeed decreases to cause the two grinding stones 9 and 11 to interfere with each other before they infeed. In order to eliminate such inconveniences, the dimension signal $IK_2$ from the inner diameter measuring device 22, the signal $MS_2$ from the microswitch 27 for "inner diameter grinding allowance, large", and the signal $MS_3$ from the microswitch 28 for "inner diameter grinding allowance, small" are compared as to when they are sent and also the dimension signal $TK_2$ from the outer diameter measuring device 23, the signal $MS_5$ from the microswitch 34 for "outer diameter grinding stone, large", and the signal $MS_6$ from the microswitch 35 for "outer diameter grinding stone, small" are compared as to when they are sent, so that if the relation between the workpiece inner diameter dimension and the internal grind infeeding head 14 is upset, calibrating operations E and F are selected, while if the relation between the workpiece outer diameter dimension and the external grind infeeding head 16 is upset, calibrating operations C and D are selected.

The calibration C may be considered in the same way as the calibration A since the cycle is composed on the basis of the external grind infeeding head 16, and it may be effected by reversely rotating the external grind infeed compensation device 33 to move back the compensation member 32 in a direction opposite to the direction of arrow 42. Further, the calibration D may be considered in the same way as the calibration B and may be effected by forwardly rotating the compensation device 33 to advance the compensation member 32 in the direction of arrow 42. On the other hand, the calibrations E and F will encounter problems. This is because in these cases of the calibrations E and F for "inner diameter grinding stone large" and "inner diameter grinding stone, small", what corresponds to the inner diameter of the workpiece 10 is not the internal grind infeeding head 14 but the position of the dresser 29 which determines the size of the inner diameter grinding stone 9, so that it would be nonsense to perform a calibrating operation for changing the position of the compensation member 25. Stated in more detail, the internal grind infeeding head 14 and the dresser 14 are attached to different parts, the former to the internal grind compensation member 25 and the latter to the machine bed 38. Therefore, even if internal grind compensation member 25 is moved in the direction of arrow 41 with the intention of making the calibration E for "inner diameter grinding stone, small", the relative positions of the stone and workpiece would be the same as before such calibration is made unless the position of the dresser 29 which will work in the initial portion of the next grinding cycle is changed. In other words, the dresser 28 is fixed in position, and between a grinding cycle and the next grinding cycle, the internal grind compensation member 25 is advanced a predetermined distance in the direction of arrow 41 by the compensation device 28 to thereby dress the inner diameter grinding stone 9 by a predetermined amount. However, even if the internal grind compensation member 25 is advanced in the direction of arrow 41 as an operation of calibration E, the relative positions of the stone and the stone large microswitch 27 will remain unchanged, making such calibration E nonsense. In the case of the outer diameter grinding stone 11, there is no such problem since together with the dress compensation device 37, it is attached to the external grind compensation member 32. Therefore, in the case of the compensation E for "inner diameter grinding stone, large", the dress compensation device 30 is actuated to move the dresser 29 in the direction of arrow 43 to make the stone smaller. In the case of the calibration F, the dress calibration device 30 is reversely rotated to move the dresser 29 in a direction opposite to the direction of arrow 43 to make the stone larger.

The foregoing description refers to the infeed cycle for external grinding precedence according to the invention.

Figure 10:
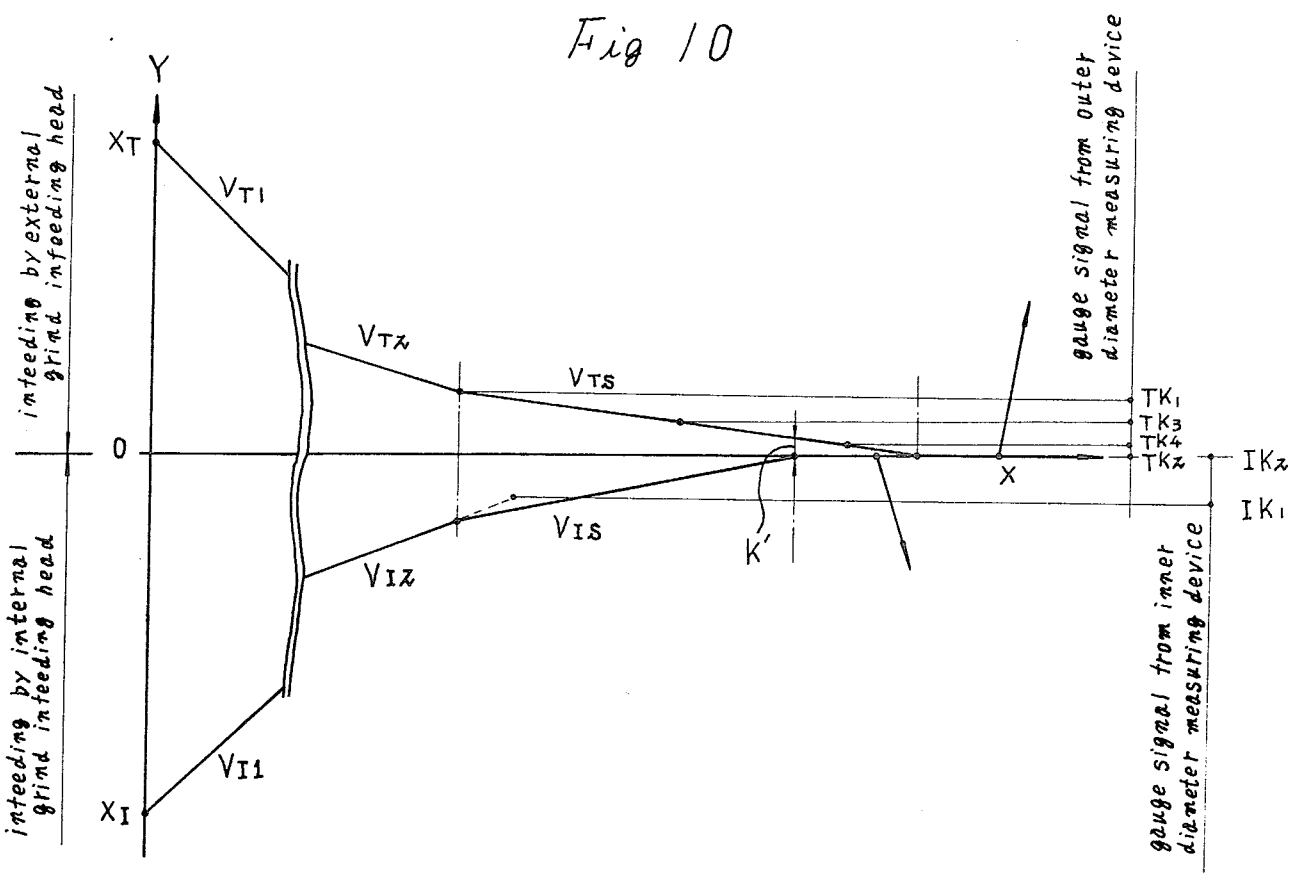
FIG. 10 is a cycle diagram for internal grinding precedence.

The infeed cycle for internal grinding precedence will now be outlined with reference to FIG. 10. As shown in FIG. 10, the cycle which lasts until the signal $TK_1$ is sent is the same as in the external grinding precedence cycle and the calibrating operations for "outer diameter grinding stone, large" and "outer diameter grinding stone, small" are also the same. However, it is necessary to provide a signal for supervising the remaining precision grinding allowance K' of the outer diameter when instead of "inner diameter grinding allowance, large" or "inner diameter grinding allowance, small", the signal $IK_2$ (dimension "O" signal) associated with the precedence cycle is sent. As for the calibrating operation to be performed when such signal is sent, in the case of "outer diameter grinding allowance, large", since the external grind infeed is delayed, the compensation device 38 is actuated to advance the compensation member 32 in the direction of arrow 42, and in the case of "outer diameter grinding allowance, small", since the external grind infeed is advanced too much, the compensation member 32 is moved back in a direction opposite to the direction of arrow 42.

In addition, in setting infeed speeds for the different stages described above, in order to make it possible to change infeed even if any of the infeed change signals $GE_1$, $GE_2$, $MS_1$, $MS_4$ is sent before the signal $TK_1$ is sent from the outer diameter measuring device 28, they may be set according to the following equations.

$$\frac{(X_T - \delta T)}{V_{T1}} = \frac{(V_I - \delta I)}{V_{I1}}$$

$$\frac{(X_T - \delta T)}{V_{T2}} = \frac{(V_I - \delta I)}{V_{I2}}$$

$$\frac{\delta T}{V_{TS}} = \frac{(\delta I - K)}{V_{IS}} \; ; (IK_4 \leqq K \leqq IK_3)$$

$$\therefore \frac{V_{T1}}{V_{I1}} = \frac{V_{T2}}{V_{I2}} = \frac{(X_T - \delta T)}{(X_I - \delta I)}$$

$$\frac{\delta T}{(\delta I - K)} = \frac{V_{TS}}{V_{IS}}$$

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A method of controlling infeed in compound grinding for simultaneously grinding the inner and outer diameters of an annular workpiece with a multiple infeed speed, comprising the steps of starting the simultaneous rough grinding of the inner and outer diameters at rough grinding infeed speeds so determined as to simultaneously reach predetermined allowances for precision grinding, completing the rough grinding of the inner diameter in response to a signal indicating the completion of the rough grinding of the outer diameter, and simultaneously starting precision grinding at precision grinding infeed speeds such that when the precision grinding of one of said inner or outer diameter is completed, the other of said inner or outer diameter has a remaining predetermined allowance for precision grinding, monitoring the inner and outer diameters and adjusting the starting point for precision grinding of the other of said inner or outer diameter when the other of said inner or outer diameter will not have the remaining predetermined allowance for precision grinding upon completion of the precision grinding of the one of said inner or outer diameter.

2. A method as set forth in claim 1, wherein upon completion of the rough grinding, the chucking force on the annular workpiece is reduced and an inner diameter grind infeeding head alone is slightly retracted.

3. A method as set forth in claim 2, wherein the grinding infeed speed at the start of the precision grinding infeed, is the rough grinding infeed speed and this speed is changed to the precision grinding infeed speed by the actuation of a gap eliminator.

4. A method as set forth in claims 1 or 2 wherein timing control signals to be sent at a predetermined interval of time and immediately before one diameter for which precision grinding is subsequent has said precision grinding completed are set at two stages, and the infeed starting positions of the internal and external grind infeeding heads are displaced relative to each other so that a signal indicating the completion of the precedent precision grinding of the other diameter will be sent between the times of sending of said control signals, whereby the relative proceeding relation between the grinding cycles for both diameters is maintained constant.

5. A method as set forth in any of claims 1 through 3, wherein the precision grinding of the outer diameter is completed first.

6. A method as set forth in any of claims 1 through 3, wherein the precision grinding of the inner diameter is completed first.

7. A method as set forth in claim 1 including positioning said workpiece between inner and outer diameter grinding heads such that an acute angle is formed between the line passing through the center of the inner diameter grinding head and the point of contact of the inner diameter grinding head and the workpiece and the line passing through the center of the outer diameter grinding head and the point of contact of the outer diameter grinding head and the workpiece.

* * * * *